US008651625B2

(12) United States Patent
Karlinski

(10) Patent No.: US 8,651,625 B2
(45) Date of Patent: Feb. 18, 2014

(54) FLUID EJECTION DEVICE

(75) Inventor: Haggai Karlinski, Ramat Chen (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/641,467

(22) PCT Filed: Apr. 29, 2010

(86) PCT No.: PCT/US2010/032892

§ 371 (c)(1),
(2), (4) Date: Oct. 16, 2012

(87) PCT Pub. No.: WO2011/136774

PCT Pub. Date: Nov. 3, 2011

(65) Prior Publication Data

US 2013/0033551 A1 Feb. 7, 2013

(51) Int. Cl.
*B41J 2/05* (2006.01)

(52) U.S. Cl.
USPC ..... 347/66

(58) Field of Classification Search
USPC ..... 347/56, 63, 65, 67–68; 890/1, 43
See application file for complete search history.

(56) References Cited

U.S. PATENT DOCUMENTS

| | | | | |
|---|---|---|---|---|
| 4,894,664 | A * | 1/1990 | Tsung Pan | 347/63 |
| 5,677,718 | A | 10/1997 | Crawford et al. | |
| 6,000,787 | A | 12/1999 | Weber et al. | |
| 6,113,221 | A | 9/2000 | Weber | |
| 6,595,627 | B2 * | 7/2003 | Min et al. | 347/65 |
| 6,641,744 | B1 | 11/2003 | Kawamura et al. | |
| 7,125,731 | B2 * | 10/2006 | Haluzak et al. | 438/21 |
| 7,163,278 | B2 * | 1/2007 | Lee et al. | 347/56 |
| 7,243,648 | B2 * | 7/2007 | Yang et al. | 128/200.16 |
| 7,470,010 | B2 | 12/2008 | Silverbrook | |
| 2003/0081072 | A1 | 5/2003 | Trueba | |

* cited by examiner

*Primary Examiner* — Anh T. N. Vo

(57) ABSTRACT

A fluid ejection device includes a chamber, at least one fluid supply channel, and more than two fluid inlets disposed between the fluid channel and the chamber. An inkjet printing system includes a fluid ejection device having a chamber disposed along fluid supply channels within the fluid ejection device, where a first channel is disposed along a first side of the chamber and a second channel is disposed along a second side of the chamber. The chamber includes multiple fluid inlets, where a first plurality of fluid inlets is disposed between the chamber and the first channel and a second plurality of fluid inlets is disposed between the chamber and the second channel.

16 Claims, 4 Drawing Sheets

FLUID EJECTION DEVICE

BACKGROUND

Conventional drop-on-demand inkjet printers are commonly categorized based on one of two mechanisms of drop formation within the inkjet printhead. A thermal bubble inkjet printer uses a heating element actuator in an ink-filled chamber to vaporize ink and create a bubble that forces an ink drop out of a nozzle. A piezoelectric inkjet printer uses a piezoelectric material actuator on a wall of an ink-filled chamber to generate a pressure pulse that forces a drop of ink out of the nozzle.

In both cases, after an ink drop is ejected from the ink chamber and out through the nozzle, the chamber is refilled with ink through an ink inlet that provides fluidic communication between the chamber and an ink supply channel. The size of the ink inlet is a result of a compromise between the need to quickly refill the chamber and the need to minimize the back flow of ink into the ink supply channel during the drop ejection or jetting event. A large ink inlet opening provides for a faster refill of the ink chamber, but it also allows a substantial amount of the drop ejection energy generated by the piezo element or thermal resistor element to be lost to the back flow of ink into the ink supply channel. As a result, more ejection energy is required to drive the ink droplets. In addition, a large back flow of ink into the ink supply channel gives rise to pressure oscillations in the supply channel which causes hydraulic cross-talk in adjacent ink chambers.

The sizing of the ink inlet and nozzle relative to one another is generally known as impedance matching. Usually, the size of the ink inlet radius is on the same order of magnitude as the size of the nozzle radius. However, if the size of the inlet radius relative to the size of the nozzle radius is incorrect, there is a poor impedance match which can result in either nozzle starvation (i.e., too little ink ejected through the nozzle) or excessive oscillations in the drop velocity and drop volume, especially as the ejection or jetting frequency is increased.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
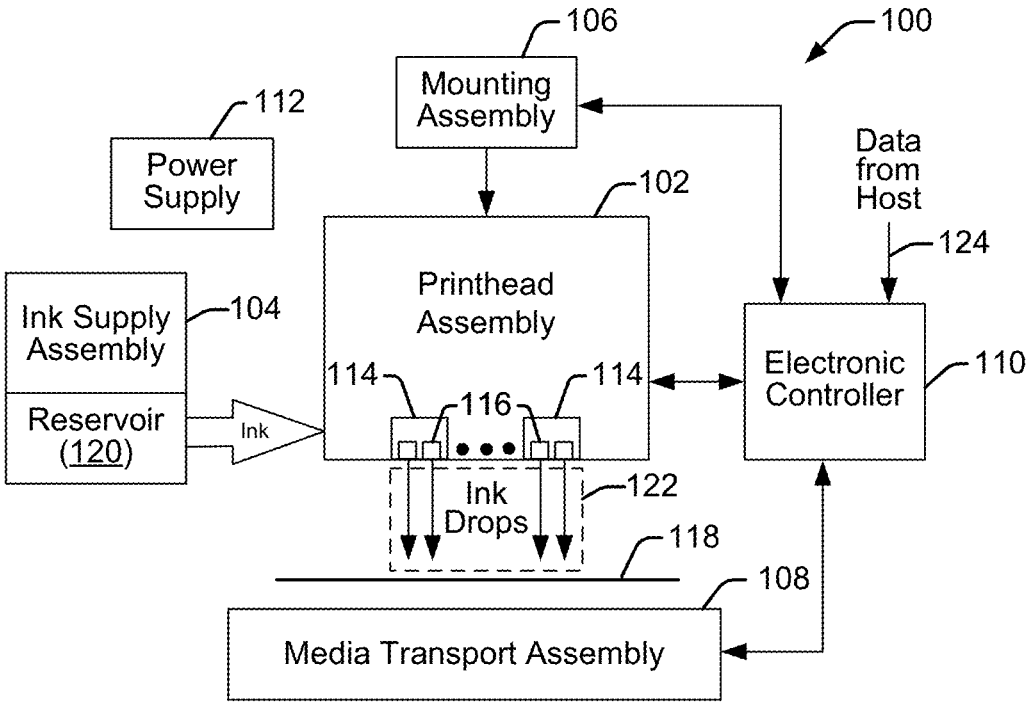
FIG. 1 illustrates an inkjet printing system suitable for incorporating a fluid ejection device, according to an embodiment.

As noted above, the relative size of an ink chamber inlet to an ink chamber nozzle (i.e., impedance matching) is an important factor in the drop ejection performance of an inkjet printhead. Poor impedance matching between the ink inlet and nozzle can result in poor print quality due to nozzle starvation or excessive oscillations in the drop velocity and drop volume, especially at higher ejection or jetting frequencies.

Traditionally, printhead ink chambers have had only one or two large ink inlets into the ink chamber. In addition to the noted challenge of matching impedance between the inlet(s) and nozzle, having only one or two ink inlets has also generally limited the available shapes that can be used when forming ink chambers. For example, conventional chambers have had to be more elongated at the input and output points to avoid having stagnant spots where air bubbles can form.

Embodiments of the present disclosure overcome disadvantages of traditional printhead designs such as those mentioned above, generally through an inkjet printhead that has multiple (i.e., more than two) ink inlets into the ink chamber. Thus, an ink chamber can have many small inlets that provide various advantages such as preventing air bubbles, particles and other contamination from reaching the nozzle. The ability to place numerous ink inlets in different locations within the chamber also enables a greater flexibility in the shape of the chamber. For example, chambers can have shapes that are closer to round or square, which allows them to be more compact. Varying the ink inlet shapes within and among chambers can improve fluid flow during ink purging operations, for example, and can also help control ink pressures when pressure drops occur toward the extreme ends of an ink channel. In addition, many small inlets can provide a lower flow impedance during chamber refill and a higher impedance during drop ejection. This reduces the amount of ink back flow and associated cross talk, allows for increased ejection/jetting frequency, and maintains drop ejection energy for improved ejection performance and general print quality. The multi-inlet design is also particularly suitable for MEMS fabrication techniques where multiple accurate small holes are fabricated with a single mask.

In one example embodiment, a fluid ejection device includes a chamber and at least one fluid supply channel. In the chamber there are more than two fluid inlets disposed between the fluid channel and the chamber. In another embodiment a method of fabricating an inkjet printhead includes forming an ejection element on a substrate, forming a chamber that surrounds the ejection element where the chamber is defined by a chamber layer, forming at least one channel, and forming at least three fluid inlets that extend between a channel and the chamber. In another embodiment, an inkjet printing system includes a fluid ejection device, a chamber disposed along fluid supply channels within the fluid ejection device, where a first channel is disposed along a first side of the chamber and a second channel is disposed along a second side of the chamber, and multiple fluid inlets in the chamber, where a first plurality of fluid inlets is disposed between the chamber and the first channel and a second plurality of fluid inlets is disposed between the chamber and the second channel.

ILLUSTRATIVE EMBODIMENTS

FIG. 1 illustrates an inkjet printing system 100 suitable for incorporating a fluid ejection device as disclosed herein, according to an embodiment. In this embodiment, the fluid ejection device is disclosed as a fluid drop jetting printhead 114. Inkjet printing system 100 includes an inkjet printhead assembly 102, an ink supply assembly 104, a mounting assembly 106, a media transport assembly 108, an electronic controller 110, and at least one power supply 112 that provides power to the various electrical components of inkjet printing system 100. Inkjet printhead assembly 102 includes at least one printhead (fluid ejection device) or printhead die 114 that ejects drops of ink through a plurality of orifices or nozzles 116 toward a print medium 118 so as to print onto print medium 118. Print medium 118 is any type of suitable sheet material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed upon print medium 118 as inkjet printhead assembly 102 and print medium 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 120 of ink supply assembly 104 may be removed, replaced, and/or refilled. In one embodiment, where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print medium 118 relative to inkjet printhead assembly 102. Thus, a print zone 122 is defined adjacent to nozzles 116 in an area between inkjet printhead assembly 102 and print medium 118. In one embodiment, inkjet printhead assembly 102 is a scanning type printhead assembly. As such, mounting assembly 106 includes a carriage for moving inkjet printhead assembly 102 relative to media transport assembly 108 to scan print medium 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print medium 118 relative to inkjet printhead assembly 102.

Electronic controller or printer controller 110 typically includes a processor, firmware, and other printer electronics for communicating with and controlling inkjet printhead assembly 102, mounting assembly 106, and media transport assembly 108. Electronic controller 110 receives data 124 from a host system, such as a computer, and includes memory for temporarily storing data 124. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic controller 110 controls inkjet printhead assembly 102 for ejection of ink drops from nozzles 116. Thus, electronic controller 110 defines a pattern of ejected ink drops which form characters, symbols, and/or other graphics or images on print medium 118. The pattern of ejected ink drops is determined by the print job commands and/or command parameters.

In one embodiment, inkjet printhead assembly 102 includes one printhead 114. In another embodiment, inkjet printhead assembly 102 is a wide-array or multi-head printhead assembly. In one wide-array embodiment, inkjet printhead assembly 102 includes a carrier which carries printhead dies 114, provides electrical communication between printhead dies 114 and electronic controller 110, and provides fluidic communication between printhead dies 114 and ink supply assembly 104.

In one embodiment, inkjet printing system 100 is a drop-on-demand piezoelectric inkjet printing system wherein the printhead 114 is a piezoelectric inkjet printhead. The piezoelectric printhead implements a piezoelectric ejection element in an ink chamber to generate pressure pulses that force ink or other fluid drops out of a nozzle 116. In another embodiment, inkjet printing system 100 is a drop-on-demand thermal bubble inkjet printing system wherein the printhead 114 is a thermal inkjet printhead. The thermal inkjet printhead implements a thermal resistor ejection element in an ink chamber to vaporize ink and create bubbles that force ink or other fluid drops out of a nozzle 116.

Figure 2:
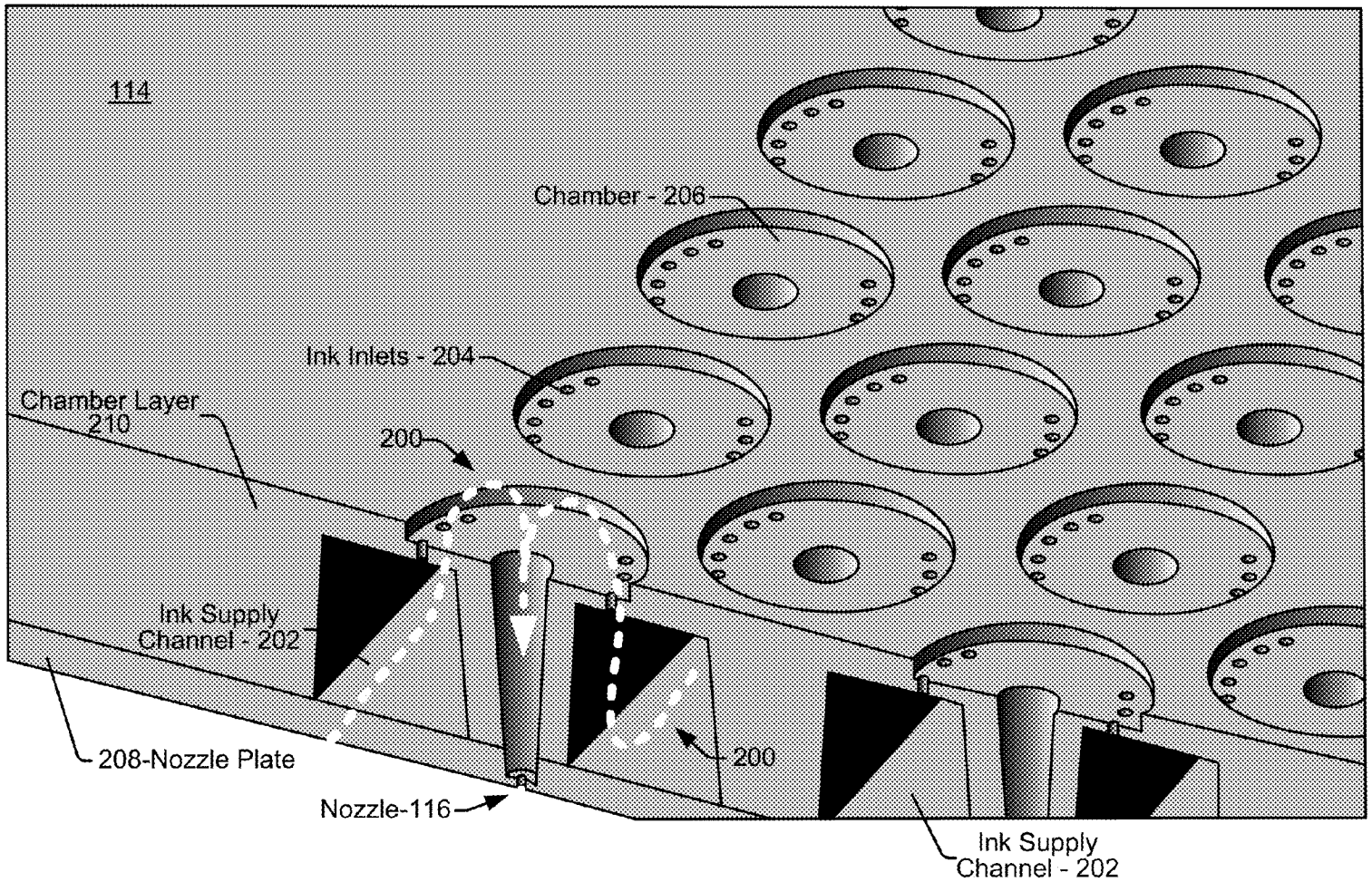
FIG. 2 illustrates a perspective view of a partial fluid ejection device having multiple fluid inlets into a chamber, according to an embodiment.

FIG. 2 illustrates a perspective view of a partial fluid ejection device implemented as inkjet printhead 114 having multiple fluid/ink inlets (i.e., greater than two ink inlets) into a fluid/ink chamber, according to an embodiment. In this view, an example fluid path 200 is shown with white dotted lines and arrow 200 to illustrate the flow of ink, for example, from fluid supply channels 202 through multiple fluid inlets 204 and into a chamber 206. When an ejection or jetting event occurs, the fluid continues out of the chamber 206 through a nozzle 116 formed within nozzle plate 208, as shown by arrow 200. In this embodiment the fluid supply channels 202 are defined by the chamber layer 210 and nozzle plate 208. The proximity of the supply channels 202 to the chambers 206 facilitates fluid communication between the supply channels 202 and chambers 206 via multiple fluid inlets 204. Although supply channels 202 are shown as being formed within chamber layer 210, in other embodiments they may be formed elsewhere such as within the printhead substrate (not shown), as long as an adjacent proximity is maintained between the supply channels 202 and chambers 206 that enables a fluid communication there between through multiple fluid inlets 204.

Figure 3:
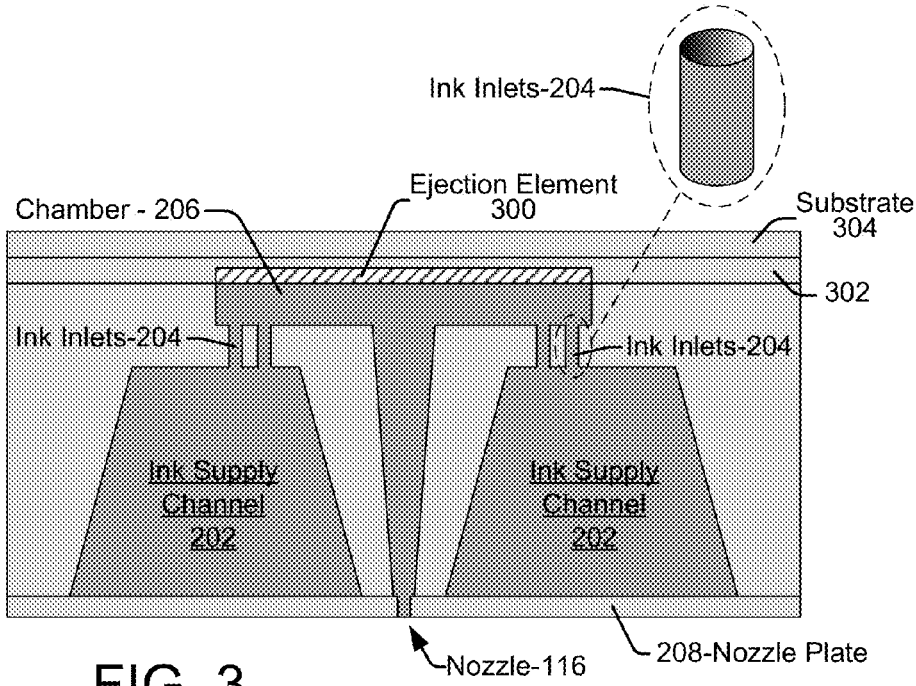
FIG. 3 illustrates a side view of an inkjet printhead that includes representations of an ejection element and printhead substrate, according to an embodiment.

FIG. 3 illustrates a side view of the inkjet printhead 114 that includes representations of an ejection element and printhead substrate, according to an embodiment. Ejection element 300 is generally formed in a thin film layer 302 on a silicon substrate 304. A piezoelectric ejection element 300 includes a diaphragm layer (not specifically illustrated) disposed over chamber 206 and bonded, for example, by a conductive anisotropic adhesive to a piezoceramic film. A thermal resistor ejection element 300 includes a thermal resistor which is typically coated with a cavitation barrier.

FIG. 3 additionally illustrates a blow-up view of a fluid/ink inlet 204. The fluid inlet 204 shown in FIG. 3 is cylindrically shaped. However, various other axisymmetric geometries that present favorable fluid flow properties, such as chamber refill and minimal back-flow properties (e.g., low impedance refill flow into the chamber from the supply channel 202, and high impedance back-flow from the chamber into the supply channel) are also contemplated. For example, in addition to cylindrical fluid inlets 204, conical and bell-shaped inlets 204 can provide such properties.

Figure 4:
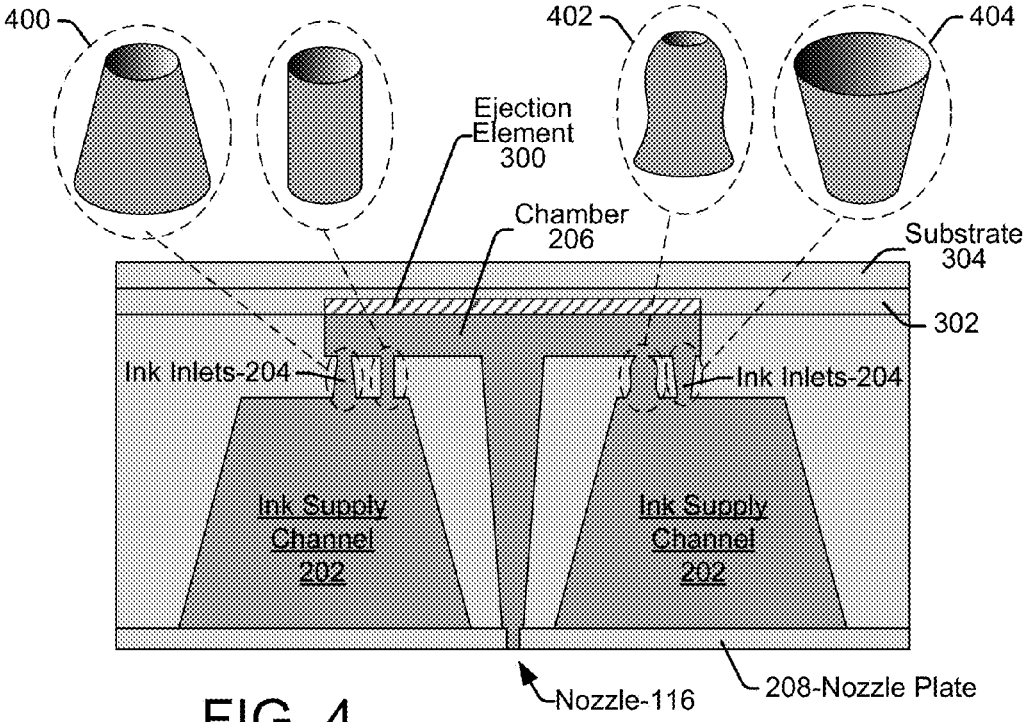
FIG. 4 illustrates a side view of an inkjet printhead with fluid inlets having example shapes that include cylindrical, conical, and bell shapes, according to an embodiment.

FIG. 4 illustrates another side view of the inkjet printhead 114 with fluid inlets 204 having example shapes that include cylindrical, conical, and bell shapes, according to an embodiment. For inlet shapes that have tapered geometries, such as the conical inlets 400, 404, and bell-shaped inlet 402 of FIG. 4, the orientation of the inlets can be such that the wide end of the inlet with the larger opening is facing toward, or opening into, the fluid supply channel 202, while the narrower opening of the inlet opens into the chamber 206. As shown in FIG. 4, for example, the conically shaped fluid inlet 400 is oriented such that the larger opening of the inlet opens into the supply channel 202 and the narrower opening of the inlet opens into the chamber 206. In other embodiments, however, it is advantageous to have varying orientations and shapes among the inlet shapes with tapered geometries (e.g., to facilitate fluid circulation in the chamber or a purging operation as described below). In such cases, a conically shaped fluid inlet 404, for example, can be oriented such that the larger opening of the inlet opens into the chamber 202 and the narrower opening of the inlet opens into the ink supply channel 206.

It is apparent from the fluid inlets 204 in FIGS. 3 and 4, that a particular chamber 206 can have inlets with structural features that are all of the same shape, size and orientation, and/or a chamber 206 can have inlets with structural features that are of different shapes, sizes and orientations. Accordingly, inlets disposed in one area of a chamber to provide fluid communication with a first supply channel may be shaped, sized and/or oriented differently than inlets disposed in a different area of the chamber to provide fluid communication with a second supply channel. In addition, among numerous chambers 206 disposed along one or more supply channels 202, one chamber can have inlets that are shaped, sized, oriented and/or positioned differently than inlets in another chamber. Such a variable arrangement in placement, size, shape and orientation of fluid inlets 204 to a chamber 206 can provide advantages such as enabling easy fluid flow from one supply channel to the other (i.e., circulation in chamber), preventing air bubbles and other contamination from reaching the nozzles, enabling greater flexibility in the shaping of the chamber, improving fluid flow through chambers during purging operations, and controlling fluid pressures to chambers at the extreme ends of supply channels 202 where fluid pressures can drop.

The number of fluid inlets 204 into a chamber 206 greater than two can also vary, with the maximum number depending on the ratio between the length of the fluid inlet 204 and its radius, and depending on the space available in the chamber that is appropriately proximal to one or more supply channels 202. These factors generally relate to the microfabrication techniques being used to form the inlets 204 and the material in which the inlets 204 are being formed (e.g., silicon). For example, when etching a fluid inlet 204, the depth of the etch (i.e., the depth of the inlet) may be limited to something on the order of 10 times the radius of the inlet. And as noted above, the proximity of the supply channels 202 to the chambers 206 facilitates fluid communication between the supply channels 202 and chambers 206 via multiple fluid inlets 204. Accordingly, in the embodiments of FIGS. 2-4, for example, fluid inlets 204 can be formed in the chamber 206 in areas that provide access through the chamber wall to the underlying or adjacent supply channel 202.

Figure 5:
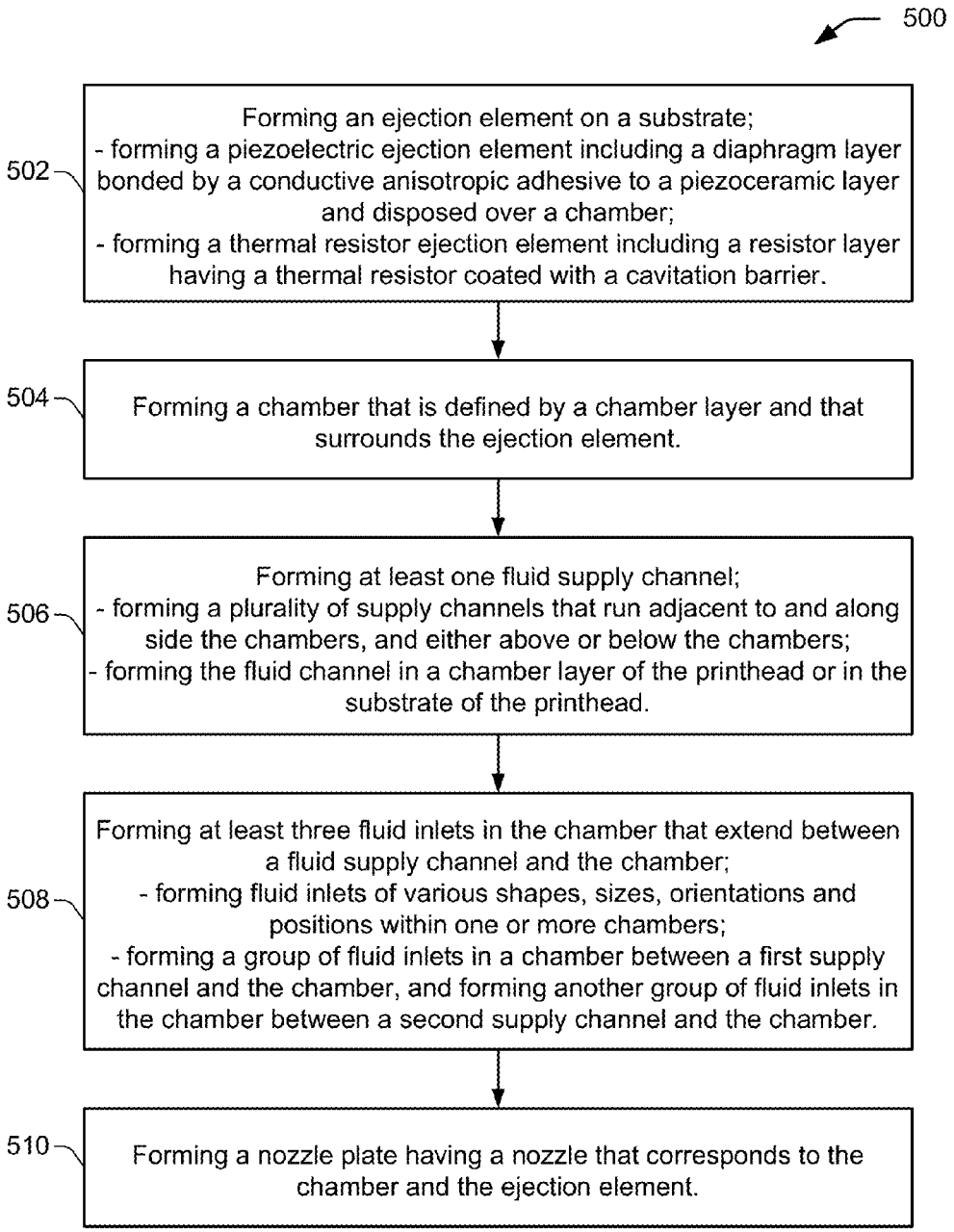
FIG. 5 shows a flowchart of an example method of fabricating a fluid ejection device, according to an embodiment.

FIG. 5 shows a flowchart of an example method 500 of fabricating a fluid ejection device such as an inkjet printhead, according to an embodiment. Method 500 is associated with the embodiments of a fluid ejection device 114 discussed above with respect to illustrations in FIGS. 1-4. Although method 500 includes steps listed in a certain order, it is to be understood that this does not limit the steps to being performed in this or any other particular order. In general, the steps of method 500 may be performed using various precision microfabrication techniques such as electroforming, laser ablation, anisotropic etching, sputtering, dry etching, photolithography, casting, molding, stamping, and machining as are well-known to those skilled in the art.

Method 500 begins at block 502 with forming an ejection element on a substrate such as a silicon substrate 304. An ejection element is generally formed on the substrate in a thin film layer stack. A piezoelectric ejection element includes a diaphragm layer bonded, for example, by a conductive anisotropic adhesive to a piezoceramic layer and disposed over a chamber. A thermal resistor ejection element includes a resistor layer having a thermal resistor which is typically coated with a cavitation barrier. The method 500 continues at block 504 with forming a chamber that is defined by a chamber layer and that surrounds the ejection element. At block 506, at least one fluid supply channel is formed. Forming the fluid supply channel can include forming a plurality of supply channels that run adjacent to and along side the chambers, and either above or below the chambers. Forming the fluid supply channel can also include forming the fluid channel in a chamber layer of the printhead or in the substrate of the printhead.

At block 508 of method 500, at least three fluid inlets are formed in the chamber that extend between a fluid supply channel and the chamber. Forming the fluid inlets can include forming fluid inlets of various shapes, sizes, orientations and positions within one or more chambers. Forming the fluid inlets can additionally include forming a group of fluid inlets in a chamber between a first supply channel and the chamber, and forming another group of fluid inlets in the chamber between a second supply channel and the chamber. The method 500 also includes at block 510, forming a nozzle plate having a nozzle that corresponds to the chamber and the ejection element.

What is claimed is:

1. A fluid ejection device comprising:

a chamber;

at least one fluid supply channel;

more than two fluid inlets disposed between the fluid supply channel and the chamber a nozzle disposed at a top side of the chamber; and an ejection element disposed at a bottom side of the chamber, wherein a first number of the fluid inlets are disposed between a first supply channel and the chamber, and a second number of the fluid inlets are disposed between a second supply channel and the chamber.

2. A fluid ejection device as in claim 1, wherein the fluid inlets have shapes selected from the group consisting of a cylindrical shape, a conical shape and a bell shape.

3. A fluid ejection device as in claim 1, wherein the fluid inlets have a tapered geometry that tapers from a wide opening at a first end to a narrow opening at a second end.

4. A fluid ejection device as in claim 3, wherein the wide opening opens to the supply channel and the narrow opening opens to the chamber.

5. A fluid ejection device as in claim 3, wherein the wide opening opens to the chamber and the narrow opening opens to the supply channel.

6. A fluid ejection device as in claim 1, wherein the fluid inlets have structural features that vary, the structural features selected from the group consisting of shapes, sizes, orientations and positions.

7. A fluid ejection device as in claim 1, comprising a plurality of chambers disposed along the at least one supply channel, and wherein shapes, sizes, orientations and relative positions of fluid inlets in a first chamber are different than shapes, sizes, orientations and relative positions of fluid inlets in a second chamber.

8. A fluid ejection device as in claim 1, comprising a plurality of chambers disposed along the at least one supply channel, and wherein a radius associated with fluid inlets in a first chamber are different than a radius associated with fluid inlets in a second chamber.

9. A fluid ejection device as in claim 1, in which the ejection element is selected from the group consisting of a piezoelectric ejection element and a thermal resistor ejection element.

10. A fluid ejection device as in claim 1, in which the fluid inlets are disposed at the top side of the chamber.

11. A fluid ejection device as in claim 1, in which the number of inlets disposed between the fluid supply channel and the chamber is based on a ratio between the length of the inlets and their respective radii, the space available in the chamber that is proximal to the fluid supply channel, or combinations thereof.

12. A method of fabricating an inkjet printhead comprising:

forming an ejection element on a substrate;

forming a chamber that surrounds the ejection element, wherein the chamber is defined by a chamber layer;

forming at least one channel; and forming at least three fluid inlets that extend between a channel and the chamber;

in which the fluid inlets have a tapered geometry that tapers from a wide opening at a first end to a narrow opening at a second end.

13. A method as recited in claim 12, wherein forming the fluid inlets comprises forming fluid inlets of varying shapes, sizes, and orientations.

14. A method as recited in claim 12, wherein forming the fluid inlets comprises forming a first plurality of fluid inlets between a first channel and the chamber and forming a second plurality of fluid inlets between a second channel and the chamber.

15. An inkjet printing system comprising:

a fluid ejection device;

a plurality of chambers disposed along fluid supply channels within the fluid ejection device; and multiple fluid inlets in each chamber of the plurality of chambers, wherein a first plurality of fluid inlets is disposed between the chamber and a first channel and a second plurality of fluid inlets is disposed between the chamber and a second channel;

in which a first chamber comprises fluid inlets that are shaped differently than fluid inlets in a second chamber.

16. A printing system as in claim 15, in which a first channel is disposed along a first side of the chamber and a second channel is disposed along a second side of the chamber.

* * * * *